US005636834A

United States Patent [19]

Horkan

[11] Patent Number: 5,636,834

[45] Date of Patent: Jun. 10, 1997

[54] FOOTBALL CONDITIONING AND INSTRUCTIONAL DEVICE

[76] Inventor: Noel P. Horkan, 99-32 64 Ave., Rego Park, N.Y. 11374

[21] Appl. No.: 408,341

[22] Filed: Mar. 22, 1995

[51] Int. Cl.[6] ..... A63B 67/00

[52] U.S. Cl. ..... 473/445

[58] Field of Search ..... 273/55 A, 55 R

[56] References Cited

U.S. PATENT DOCUMENTS

| | | | |
|---|---|---|---|
| 1,269,559 | 6/1918 | Fauver | 273/55 A |
| 2,037,508 | 4/1936 | Gilman | 273/55 A |
| 2,162,073 | 6/1939 | Evans | 273/55 R |
| 2,267,599 | 4/1941 | Gilman | 273/55 A |
| 2,449,935 | 9/1948 | Gilman | 273/55 R |

OTHER PUBLICATIONS

Preliminary patent search results.

*Primary Examiner*—Theatrice Brown

*Attorney, Agent, or Firm*—Chase & Yakimo

[57] ABSTRACT

A football instructional device comprises a plurality of blocking/tackling practice devices with a net releasably spanning the devices. Each device comprises a circular base having a truncated cone extending therefrom. The cone presents a dummy for delivering impact forces thereon. At the top of each dummy is a telescopic rod assembly with clamp thereon for adjusting the height of the net above the ground. The configuration of each device with and/or without the net forces the player to stay in a low position while practicing blocking/tackling techniques. The dummy/net combination can also define a course for players to perform muscle strengthening techniques such as "crabbing," "duck-walking" or other exercises requiring the player to move in a low position underneath the net-like ceiling.

14 Claims, 9 Drawing Sheets

FOOTBALL CONDITIONING AND INSTRUCTIONAL DEVICE

BACKGROUND OF THE INVENTION

This invention is directed to a football blocking device and, more particularly, to a device for player conditioning and/or teaching proper blocking techniques.

The use of various types of blocking devices, whether in the form of blocking dummies, sleds or pads, for instructive use is known in the art. Although assumably effective in operation, it is desirable to have a device which effectively urges linemen to utilize "low" blocking techniques while conditioning the muscles of the player to perform the same.

In response thereto I have provided an instructional system which utilizes a plurality of blocking/tackling dummies, each dummy being particularly designed to require the linemen to stay low upon contact with the device so as to effectively levy impact forces on the device. Moreover, a plurality of such blocking devices may be used to extend a ceiling above the player at user-adjustable heights above the ground. The ceiling presents a barrier under which the player must perform his conditioning and/or proper "low" blocking/tackling techniques. The blocking devices with ceiling spanning therebetween may be arranged so as to present courses of various configurations to the player. The player then moves through the course in various conditioning drills such as "crabbing," "duckwalking" or the like.

It is therefore a general object of this invention to provide a football device for teaching proper blocking/tackling techniques.

Another object of this invention is to provide a device, as aforesaid, which assists in the conditioning of the football player so as to more easily perform such techniques.

Still another object of this invention is to provide a device, as aforesaid, which urges the football player into a low position.

A further object of this invention is to provide a device, as aforesaid, which presents a desired point of impact at a ground-adjacent position.

Another particular object of this invention is to provide a device, as aforesaid, which presents a marker in the form of a ceiling under which the football player performs various blocking/tackling techniques and/or conditioning drills.

Still a further particular object of this invention is to provide a device, as aforesaid, the ceiling being variously adjustable by the user.

Still another object of this invention is to provide a device, as aforesaid, which uses a telescopic rod vertically extending from each blocking device for attaching markers thereto indicative of a height below which the player must perform his drills.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 1:
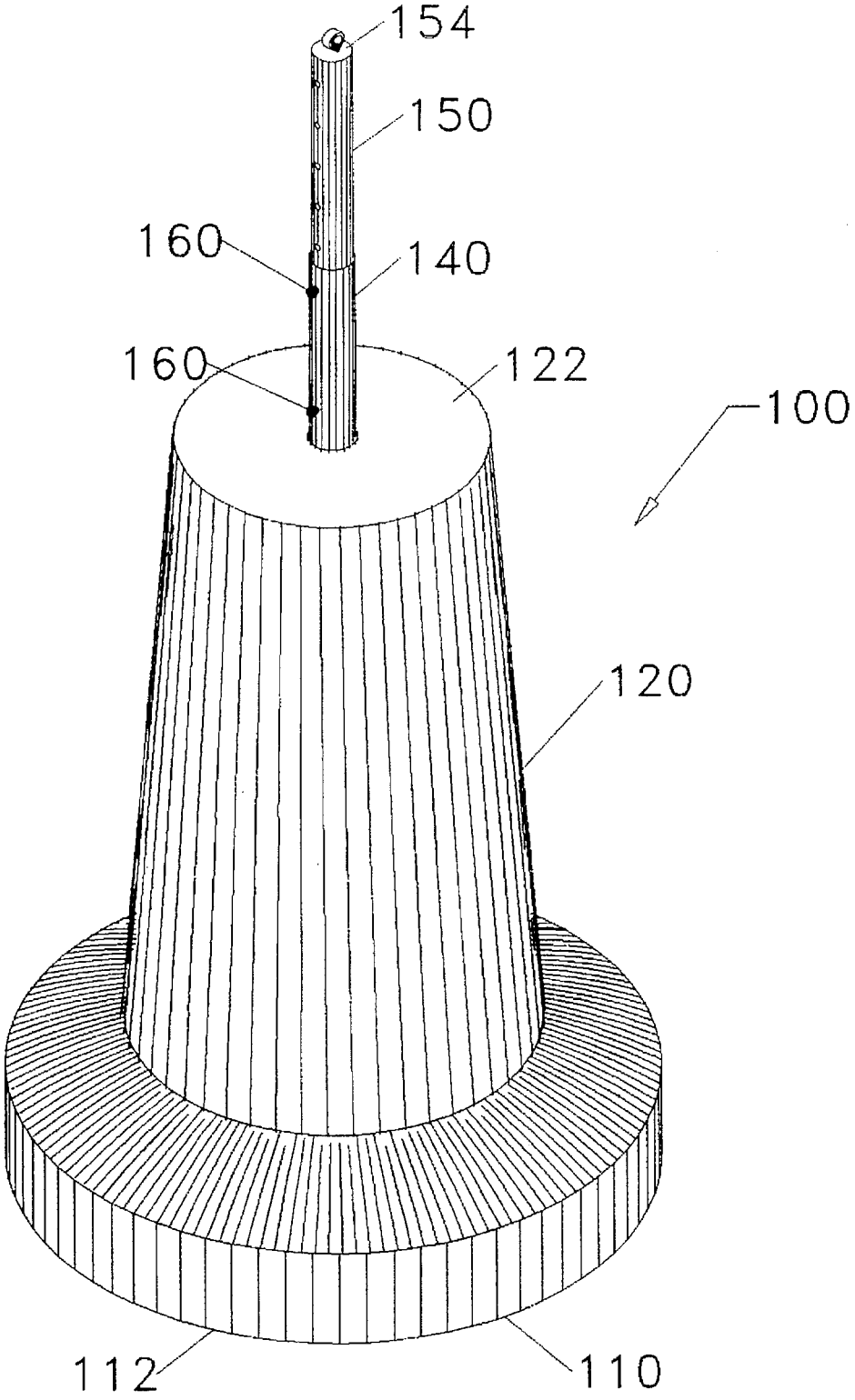
FIG. 1 is a view of one blocking device.
Figure 2:
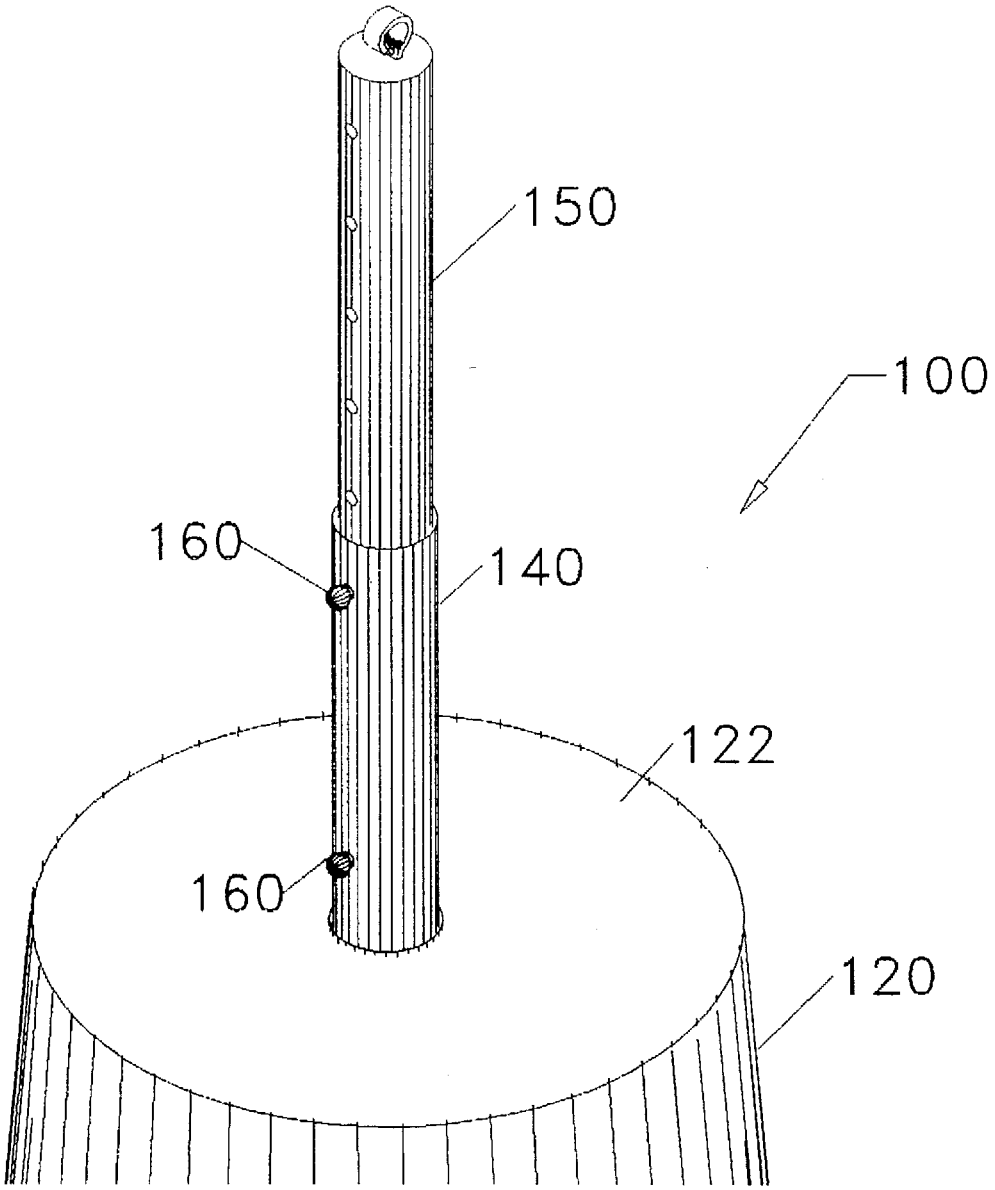
FIG. 2 is a fragmentary view of the top end of the device of FIG. 1 on an enlarged scale.
Figure 3:
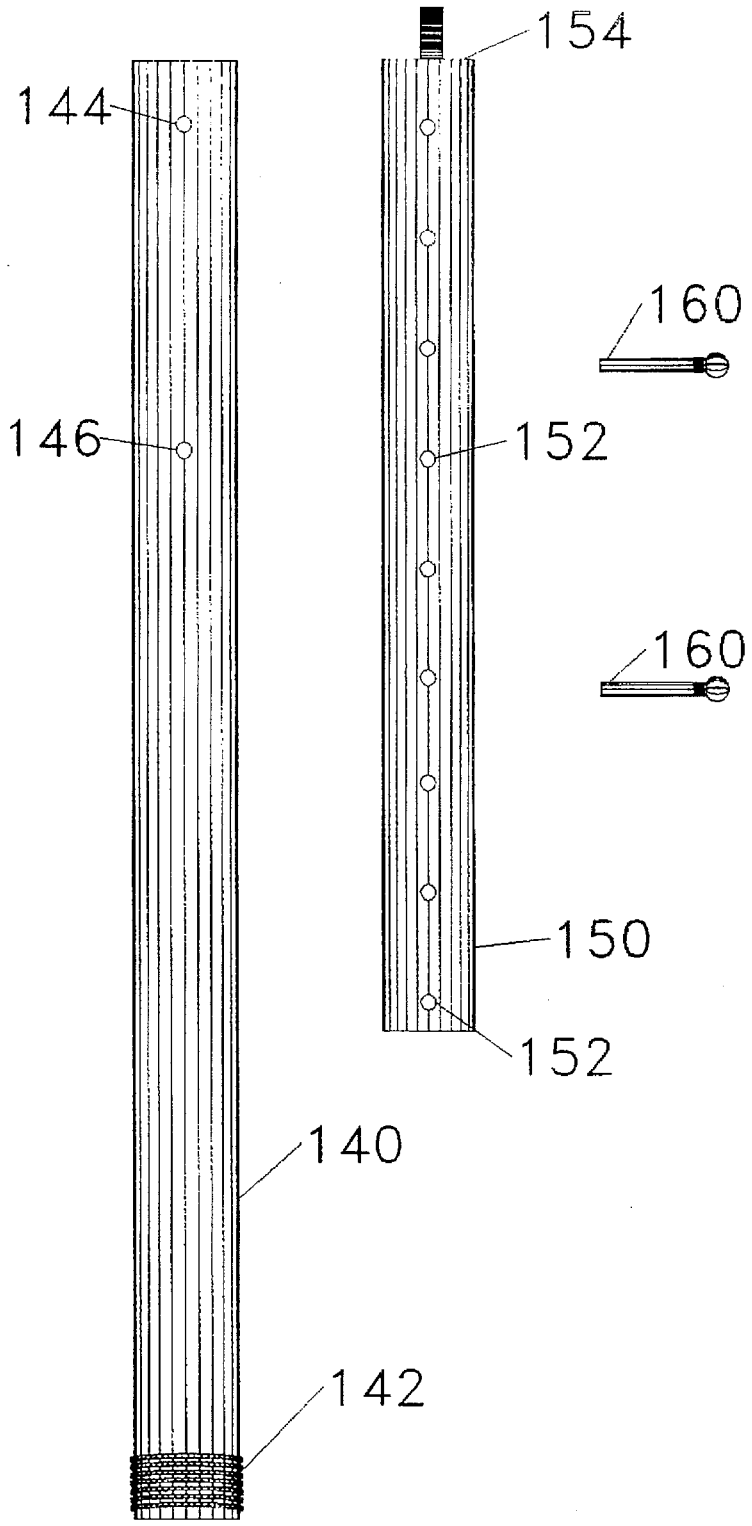
FIG. 3 is a view of the pole and rod elements of the telescopic rod assembly positioned at the top of each blocking device.
Figure 4:
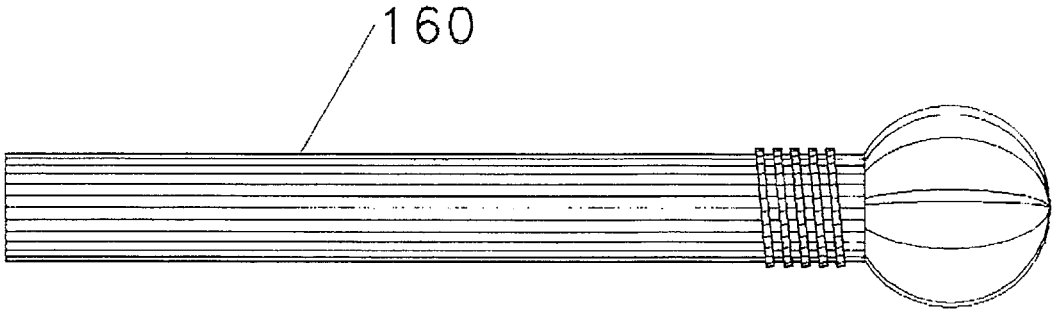
FIG. 4 is a side view, on an enlarged scale, showing a pin for maintaining the pole and rod of the telescopic rod assembly in a relative vertical relationship therebetween.
Figure 5:
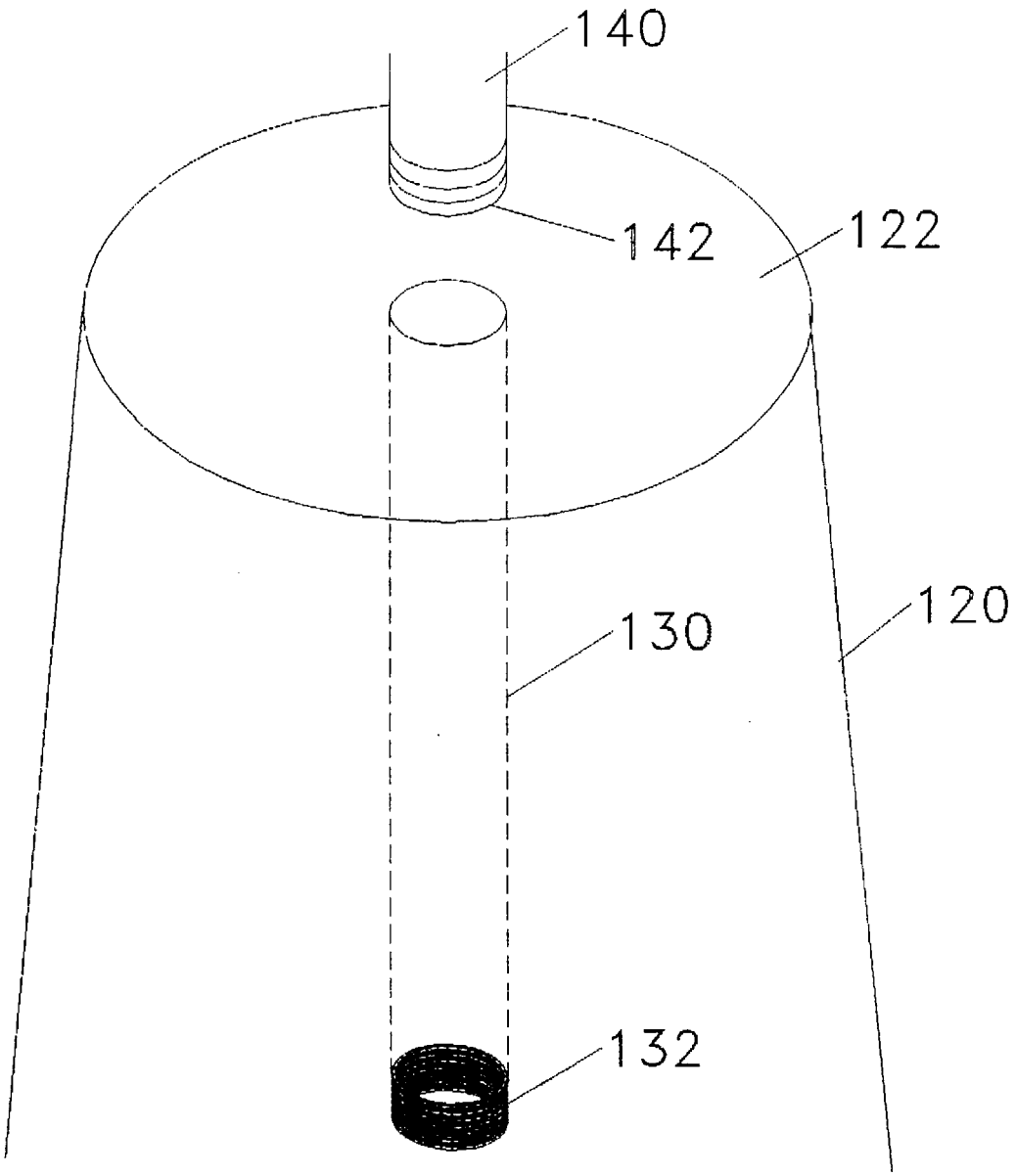
FIG. 5 is a fragmentary view showing the means of attachment of the lower rod of the telescopic rod assembly into the cylinder within the device.
Figure 6:
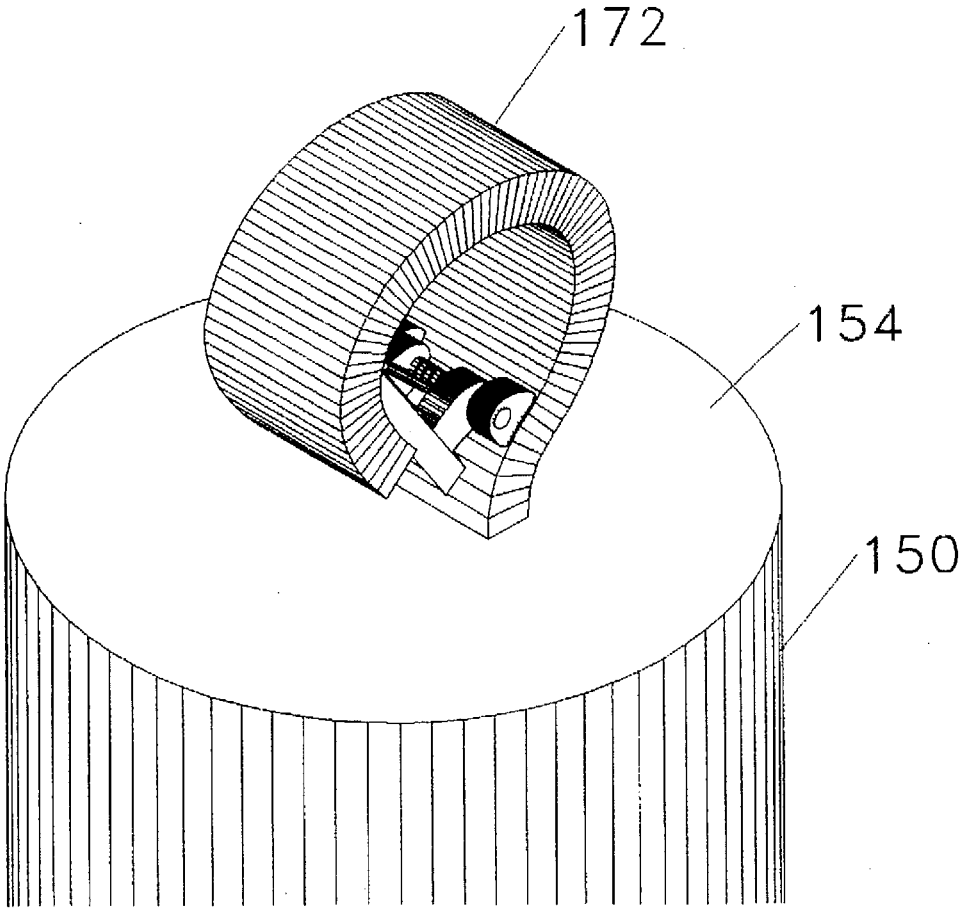
FIG. 6 is a fragmentary top view, on an enlarged scale, showing the clamping assembly atop the upper rod of the telescopic rod assembly.
Figure 7:
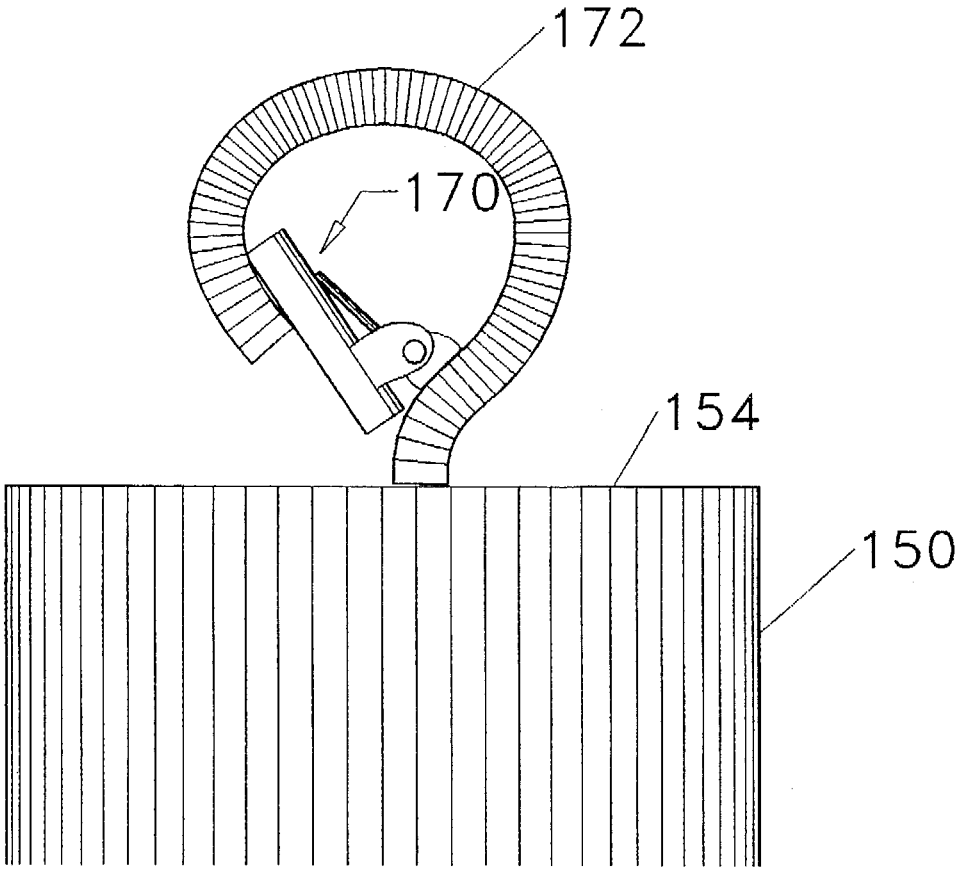
FIG. 7 is a side view of the clamping assembly of FIG. 6.

Turning more particularly to the drawings, FIG. 1 shows one blocking/tackling device 100 as presenting a circular pedestal or base 110 with a truncated cone-shaped dummy 120 upwardly extending therefrom. The base 110 generally presents a planar surface 112 for enhancing slidable movement along the underlying support surface, e.g. the ground, upon impact forces being delivered by the player onto the dummy 120. The truncated cone configuration of the dummy 120 concentrates the mass/weight of the dummy 120 at a position adjacent the pedestal 110 with the mass/weight of the dummy 120 decreasing between the pedestal 110 base and the upper free end 122 of dummy 120. As such, the pedestal 110/dummy 120 interface presents a desired target of impact to a player as the player must deliver the blocking/tackling forces at this interface so as to optimally slide the pedestal 110 along the ground. Otherwise, the closer that contact is made with the dummy 120 at the upper end 122, the more likely the dummy 120 will topple due to the decrease in mass/weight. Such toppling will be visually indicative to the instructor that an undesirable high hit on the dummy 120 has been made.

The device 100 may be made of various materials and should present at least padded contact surfaces. The weight of the dummy 120 should provide sufficient resistance to the impact forces of the football player recognizing that football players may weigh 350 pounds and more.

Located within the dummy 120 and in extension along the imaginary vertical axis thereof is an internal cylinder 130 having internal threads 132 at the lower end thereof. The cylinder 130 is designed to functionally engage the threaded ends 142 of a first pole 140 of a telescopic pole assembly, this pole 140 being slidable within the cylinder 130.

A second pole or rod 150 is slidable within the confines of first pole 140. A plurality of apertures 152 are vertically positioned along the extent of the rod 150. These apertures 152 are to be aligned with the vertically spaced-apart apertures 144, 146 found at the top end of the first pole 140. Upon such alignment, first and second pins 160 are inserted through the aligned apertures so as to maintain the vertical relationship between the first 140 and second 150 poles. Accordingly, the height of the upper end 154 of pole 150 is first adjustable and then maintained relative to the top surface 122 of the dummy 120. Atop the rod 150 is a clamping assembly presented by a clip 170 mounted within the confines of a padded hook 172 extending from the top surface 154 of the rod 150.

Figure 8:
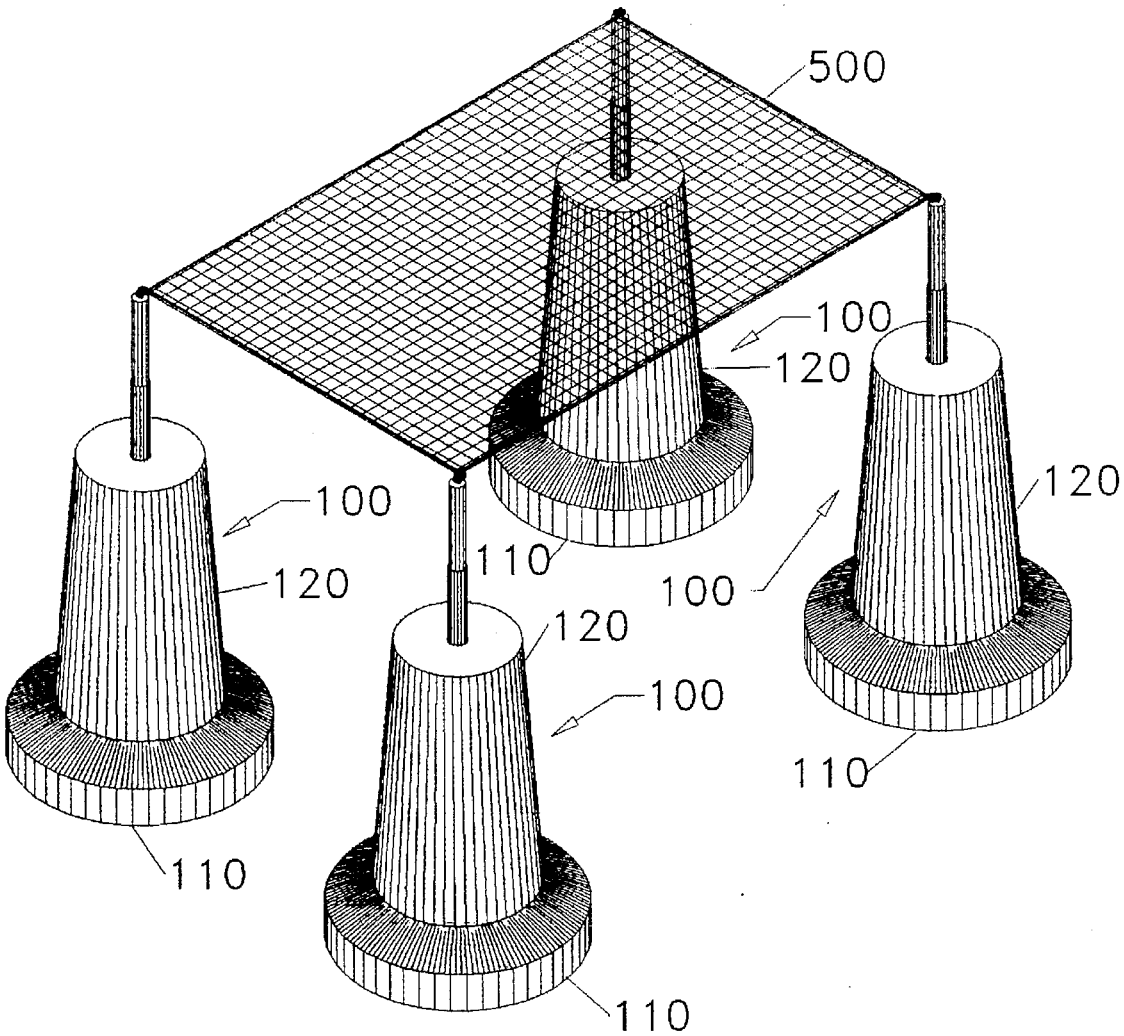
FIG. 8 is a perspective view showing the use of four of the blocking devices with a net-like ceiling spanning the devices.

The clip 170 may engage various materials, e.g. a corner or other portion of a net 500, in a clamping relationship therebetween. Accordingly, upon utilizing a plurality of devices 100, four as shown in FIG. 8, a net 500 spans the devices. The net 500 presents a ceiling under which the player must perform his conditioning/blocking drills. It is understood that other objects/markers indicative of a height under which a player must perform can be used either in connection with one device 100 or a plurality of devices 100.

In the FIG. 8 configuration the net-like ceiling 500 forces the player to perform his tackling/blocking techniques upon each dummy 120 in a low position, the height of the ceiling being adjustable by the telescopic pole 140/rod 150 assembly. The utilization of the telescopic assembly and associated clamping assembly atop rod 150 allows the coach to vary the height of the net 500 or other marker relative to the top surface 122 of the dummy 120. Thus, the height of the marker/ceiling 500 may be initially set according to the player's initial skills and may be subsequently lowered as the player advances in his "low" blocking techniques. The height of the top surface 122 of the dummy is approximately three feet relative to the ground with the telescoping rod assembly being adjustable to present the ceiling 500 between approximately three feet and six feet above the ground.

Figure 9:
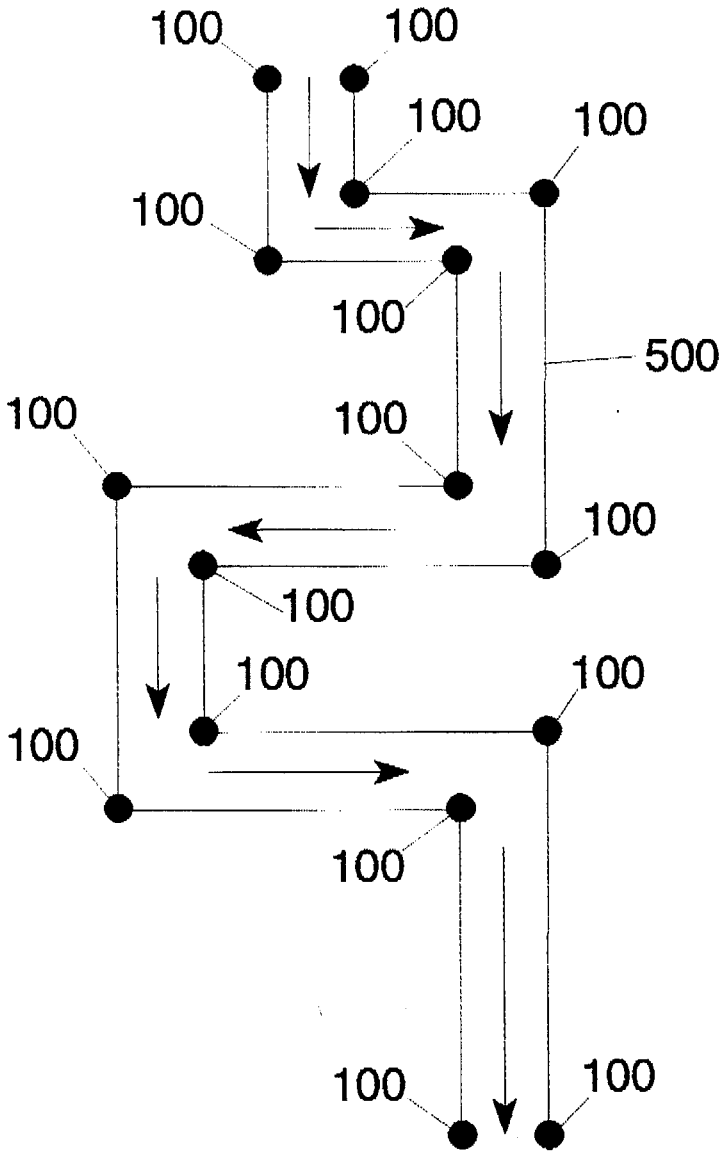
FIG. 9 is a top diagrammatic view showing one course utilizing the blocking devices with ceiling spanning therebetween.

Alternatively, as diagrammatically shown in FIG. 9, a plurality of the devices 100 may be arranged with the net-like ceiling 500 spanning therebetween so as to present a course to a player for performing various techniques thereunder. Such techniques may be "crabbing" or "duck-walk" conditioning drills. The player must constantly assume a low position underneath the net-like ceiling 500 so as to efficiently and timely negotiate the course at hand.

Accordingly, it can be seen that the devices 100 may be Jointly or severally used with and without markers and/or a ceiling as releasably engaged by the clamping assemblies. Thus, a variety of conditioning and/or blocking/tackling drills may be performed by one or more players.

It is to be understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A blocking/tackling device comprising:

a support base having an underlying surface for slidable movement along a support surface;

a padded dummy vertically extending from said support base, said dummy being in a frustoconical configuration to concentrate a majority of weight of said dummy at a position adjacent said support base, said dummy position presenting a target zone for delivering impact forces by a player thereon, whereby to optimally slide said device along said support surface;

a pole extending from a top end of said dummy;

a clamp at an upper end of said pole for releasably engaging a marker thereto, said marker indicative of a height below which the player maintains a position for delivering said impact forces;

a rod having a lower end embedded in said dummy, said rod configured to receive said pole in slidable movement therein;

a plurality of apertures along said pole;

at least one aperture in said rod for alignment with one of said apertures in said pole;

a pin extending through said aligned rod and pole apertures for maintaining said pole and clamp thereon in a selectable extension beyond said rod, whereby to adjust a height of said marker above said top end of said dummy.

2. The device as claimed in claim 1 further comprising a plurality of said devices in a spaced-apart relationship, wherein each marker of each of said devices engaged to said respective clamp cooperates to present a ceiling above the devices below which the player maintains said position for delivering impact forces.

3. The device as claimed in claim 2 wherein said markers comprise a common sheet of material, a portion of which is engaged by said clamp of each device.

4. The device as claimed in claim 3 wherein said common sheet of material comprises a flexible net.

5. The device as claimed in claim 1 wherein said support base has an upper surface having an area greater than an area of a base of said dummy extending from said upper surface of said support base.

6. A blocking/tackling device comprising:

pedestal having an underlying surface for slidable movement along a support surface;

a padded dummy vertically extending from said pedestal, said dummy configured to concentrate a majority of weight of said dummy at a position adjacent said pedestal, said intersection of said dummy and said pedestal presenting a target zone for delivering impact forces by a player thereon, whereby to optimally slide said device along the ground-adjacent surface;

a pole for extension from a top end of said dummy, said pole having an upper end with a clamp thereon for releasably engaging a marker thereto, said marker indicative of a height below which the player maintains a position for delivering said impact forces;

a rod having a lower end embedded in said dummy, said rod configured to receive said pole in slidable movement therein;

a plurality of apertures along said pole;

at least one aperture in said rod for alignment with one of said apertures in said pole;

a pin extending through said aligned rod and pole apertures for maintaining said pole and clamp thereon in a selectable extension beyond said rod, whereby to adjust a height of said marker above said top end of said dummy.

7. The device as claimed in claim 6 further comprising a plurality of said devices in a spaced-apart relationship, wherein each clamped marker of each of said plurality of devices cooperates to present a ceiling above the devices below which the player maintains a position for delivering said impact forces.

8. The device as claimed in claim 7 wherein said markers comprise a common sheet of material, a portion of which is engaged by said clamp of each device, said material sheet presenting said ceiling.

9. The device as claimed in claim 8 wherein said pedestal presents an upper surface having an area greater than an area of said base of said dummy adjacent said pedestal upper surface.

10. The device as claimed in claim 8 wherein said common sheet of material comprises a flexible net.

11. A blocking/tackling system comprising a plurality of devices, each device comprising:

a support base having an underlying surface for slidable movement along a support surface;

a padded dummy vertically extending from said support, said dummy configured to concentrate a majority of weight of said dummy at a position adjacent said support base, said dummy position presenting a target for delivering impact forces by a player thereon, whereby to optimally slide said device along the support surface;

means releasably attaching a maker at a top end of said dummy and for positioning said marker at a selected position above the top end of said dummy, said marker of each device cooperating to present a gauge indicative of a height below which the player maintains a position for delivering said impact forces.

12. The device as claimed in claim 11 wherein said markers comprise a common sheet of material, a portion of which is engaged by said clamp of each device.

13. The device as claimed in claim 12 wherein said common sheet of material comprises a flexible net.

14. The device as claimed in claim 11 wherein each dummy is frustoconical in configuration, a base of said cone adjacent said support base.

* * * * *